US010190795B2

(12) United States Patent
Ito et al.

(10) Patent No.: US 10,190,795 B2
(45) Date of Patent: Jan. 29, 2019

(54) AIR CONDITIONER DIAGNOSTIC SYSTEM, AIR CONDITIONER AND MOBILE COMMUNICATION TERMINAL

(71) Applicant: Johnson Controls-Hitachi Air Conditioning Technology (Hong Kong) Limited, Hong Kong (CN)

(72) Inventors: Makoto Ito, Tokyo (JP); Kenji Shiraishi, Tokyo (JP); Tatsuya Sugiyama, Tokyo (JP); Tomotsune Taira, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 156 days.

(21) Appl. No.: 14/914,057

(22) PCT Filed: Jul. 23, 2014

(86) PCT No.: PCT/JP2014/069391
§ 371 (c)(1),
(2) Date: Feb. 24, 2016

(87) PCT Pub. No.: WO2015/037333
PCT Pub. Date: Mar. 19, 2015

(65) Prior Publication Data

US 2016/0209074 A1 Jul. 21, 2016

(30) Foreign Application Priority Data

Sep. 10, 2013 (JP) ..... 2013-187622

(51) Int. Cl.
*F24F 11/89* (2018.01)
*F24F 11/30* (2018.01)
(Continued)

(52) U.S. Cl.
CPC ..... *F24F 11/89* (2018.01); *F04D 27/001* (2013.01); *F24F 11/30* (2018.01); *F24F 11/52* (2018.01); *F24F 11/56* (2018.01)

(58) Field of Classification Search
CPC ..... F24F 11/02; F24F 11/0086; F24F 2011/0091; F24F 2011/0068; F24F 11/89; F24F 11/30; F24F 11/56; F24F 11/52
See application file for complete search history.

(56) References Cited

U.S. PATENT DOCUMENTS 6,643,611 B1 * 11/2003 Ito ..... F24F 11/0086 702/184
9,505,494 B1 * 11/2016 Marlow ..... B64C 39/024
(Continued)

FOREIGN PATENT DOCUMENTS

JP 2002-106930 A 4/2002
JP 2003-70080 A 3/2003
(Continued)

OTHER PUBLICATIONS

International Search Report of PCT/JP2014/069391.
Japanese Office Action received in corresponding Japanese Application No. 2017-183377 dated Jul. 31, 2018.

*Primary Examiner* — Kun Kai Ma
(74) *Attorney, Agent, or Firm* — Mattingly & Malur, PC

(57) ABSTRACT

In order to derive, from operation data obtained from an air conditioner, the correct cause of malfunction of the air conditioner and the suitable repair information, a diagnostic system is connected to an outdoor unit and the indoor units of the air conditioner, which is provided with communication units. A mobile communication terminal requests that the communication units of the air conditioner transmit the operation data and the model data to the mobile communication terminal, which then communicates with a maintenance server system storing a diagnostic program corre-
(Continued)

sponding to each model of air conditioner. Then, either the maintenance server system or the mobile communication terminal uses the diagnostic program corresponding to the model data to make a diagnosis of the air conditioner on the basis of the received model data and operation data. The diagnostic result is displayed on a display unit of the mobile communication terminal.

9 Claims, 3 Drawing Sheets

(51) Int. Cl.

| | |
|---|---|
| ***F04D 27/00*** | (2006.01) |
| *F24F 11/56* | (2018.01) |
| *F24F 11/52* | (2018.01) |

(56) References Cited

U.S. PATENT DOCUMENTS 9,685,784 B2 * 6/2017 Lee ..... H02J 3/008
9,946,273 B2 * 4/2018 Kusukame ..... G05D 23/1917
2002/0029096 A1 * 3/2002 Takai ..... F24F 11/30 700/276
2004/0010347 A1 * 1/2004 Yamanashi ..... F24F 11/006 700/276
2005/0242943 A1 * 11/2005 Matsumoto ..... G01D 9/005 340/521
2006/0136175 A1 * 6/2006 Suzuki ..... G05B 23/0235 702/183
2007/0213938 A1 * 9/2007 Kai ..... G06F 19/3418 702/19
2010/0292960 A1 11/2010 Sung et al.
2010/0324741 A1 12/2010 House et al.
2011/0218957 A1 * 9/2011 Coon ..... G06Q 30/0601 706/54
2012/0101778 A1 * 4/2012 Gyota ..... F24F 11/0086 702/183
2012/0198274 A1 * 8/2012 Cho ..... H04L 12/12 714/15
2012/0303323 A1 * 11/2012 Ha ..... D06F 33/02 702/183
2012/0316984 A1 * 12/2012 Glassman ..... G06Q 50/06 705/26.7
2012/0318010 A1 12/2012 Matsumoto et al.
2013/0067942 A1 3/2013 Ochiai et al.
2014/0006953 A1 * 1/2014 Kim ..... H04L 12/282 715/727
2014/0008428 A1 * 1/2014 Na ..... G06K 1/18 235/375
2014/0031989 A1 * 1/2014 Bergman ..... G05D 23/19 700/276
2014/0087660 A1 * 3/2014 Kim ..... H04L 12/282 455/41.1
2014/0282924 A1 * 9/2014 Singhal ..... H04L 63/0853 726/5
2014/0350732 A1 * 11/2014 Kucera ..... F24F 11/0009 700/276
2014/0365018 A1 * 12/2014 Kusukame ..... G05D 23/1917 700/276
2015/0184880 A1 * 7/2015 Kawamura ..... F24F 11/00 700/276
2017/0019264 A1 * 1/2017 Nugent ..... H04L 12/282
2017/0142460 A1 * 5/2017 Yang ..... H04N 21/25816

FOREIGN PATENT DOCUMENTS

| | | | |
|---|---|---|---|
| JP | 2004-241993 | A | 8/2004 |
| JP | 2006-23051 | A | 1/2006 |
| JP | 2007-263442 | A | 10/2007 |
| JP | 2008-2752 | A | 1/2008 |
| JP | 2009-014233 | A | 1/2009 |
| JP | 2012-195141 | A | 10/2012 |
| JP | 2013-029302 | A | 2/2013 |
| WO | 2010/143340 | A1 | 12/2010 |
| WO | 2011/161720 | A1 | 12/2011 |

* cited by examiner

AIR CONDITIONER DIAGNOSTIC SYSTEM, AIR CONDITIONER AND MOBILE COMMUNICATION TERMINAL

TECHNICAL FIELD

The present invention relates to an air conditioner diagnostic system, an air conditioner, and a mobile communication terminal. More specifically, the invention relates to a system for diagnosing the air conditioner based on operation data of the air conditioner.

BACKGROUND ART

Conventionally, the art for remotely monitoring the operation state of the air conditioner has been known as the efficient means capable of immediately coping with abnormality in the air conditioner, for example.

The aforementioned remote monitor system is constituted by the air conditioner, an operation monitor device disposed near the air conditioner and connected thereto via the communication line, and a remote monitor device connected to the operation monitor device via the public network.

The operation data of the air conditioner are accumulated in the operation monitor device from the air conditioner via the communication line so that those data are transmitted to the remote monitor device via the public network.

The aforementioned system, however, has imposed substantial economical burden on a user, thus preventing progress of introduction of the system.

The system needs the communication facility dedicated to transmission of the operation data from the air conditioner to the remote monitor device, that is, the operation monitor device and the public network. Generally, investment in the dedicated communication facility for securing integrity of the air conditioner which is considered to be substantially free from failure may impose large economical burden on the user, thus preventing progress of introduction of such system.

Japanese Patent Application Laid-Open No. 2009-14233 (Patent Literature 1) discloses the system for offering efficient after-sales services to the user, which is simply configured without requiring the communication facility dedicated to remote monitor of the air conditioner.

CITATION LIST

Patent Literature

PTL 1: Japanese Patent Application Laid-Open No. 2009-14233

SUMMARY OF INVENTION

Technical Problem

The system disclosed in Patent Literature 1 is provided with a management device configured to receive operation data (air conditioner data) such information as operation history of the air conditioner, and notify the user of the air conditioner of service information such as maintenance information based on the operation data. The air conditioner operation data are transmitted from the air conditioner to the user' s mobile phone terminal which is structured to allow short-range communication with the air conditioner so as to transmit the data from the mobile phone terminal to the remotely located management device via a network, and to notify the user of the service information transmitted from the management device to the mobile phone terminal via the network.

There have been a wide variety of distributed types of air conditioners ranging from old to the latest models. The aforementioned management device has problems of difficulty in finding out the specific failure cause of the air conditioner from received operation data, or in deriving the correct failure cause or suitable repair information based on the successfully obtained failure cause.

An object of the present invention is to provide an air conditioner diagnostic system capable of deriving correct failure cause of the air conditioner, and suitable repair information based on the operation data obtained from the air conditioner, an air conditioner, and a mobile communication terminal.

Solution to Problem

The object will be achieved by the present invention which provides an air conditioner diagnostic system in which the air conditioner has an outdoor unit and an indoor unit which are connected via a communication line. The air conditioner includes a communication unit for transmitting operation data indicating an operation state of the air conditioner and model data to a mobile communication terminal. The communication unit transmits the operation data and the model data of the air conditioner only in response to a reception request from the mobile communication terminal. The mobile communication terminal is allowed to communicate with a maintenance server system installed in a remote location, which stores a diagnostic program corresponding to each model of the air conditioner. Based on the model data and the operation data received by the mobile communication terminal, the maintenance server system or the mobile communication terminal diagnoses the air conditioner using the diagnostic program corresponding to the model data for displaying a diagnostic result on a display unit of the mobile communication terminal.

The present invention provides another feature of an air conditioner including an outdoor unit and an indoor unit which are connected with each other via a communication line. The air conditioner includes an information storage unit for storing model data and operation data of the air conditioner, and a communication unit for downloading the information stored in the information storage unit into a mobile communication terminal.

The present invention provides another feature of a mobile communication terminal which includes a first communication unit allowed to communicate with a communication unit of an air conditioner, a first software provided with a program for downloading model data and operation data of the air conditioner via the first communication unit, a second communication unit for communication with a maintenance server system provided with a server which stores a diagnostic program corresponding to each model of the air conditioner, and a second software provided with a program for communication with the maintenance server system via the second communication unit, making a failure diagnosis of the air conditioner based on the downloaded operation data of the air conditioner using the diagnostic program corresponding to the downloaded model data of the air conditioner for displaying a failure diagnostic result on a display unit.

Advantageous Effects of Invention

The present invention provides the air conditioner diagnostic system capable of deriving the correct failure cause of the air conditioner, and suitable repair information based on the operation data obtained from the air conditioner, the air conditioner, and the mobile communication terminal.

DESCRIPTION OF EMBODIMENT

Figure 1:
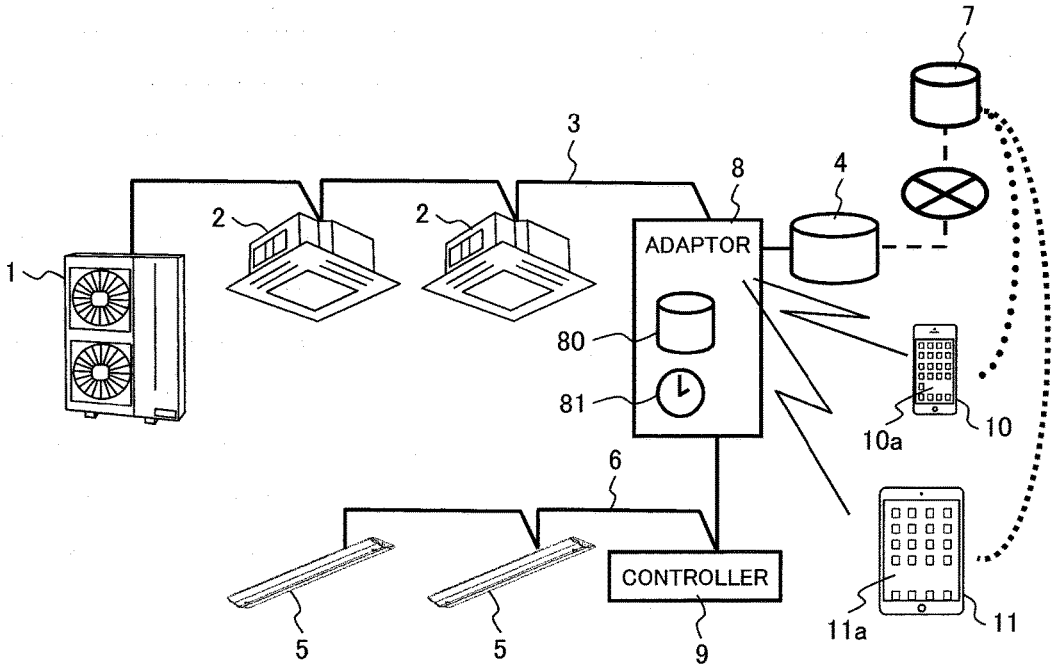
FIG. 1 shows an overall structure of a first embodiment of an air conditioner diagnostic system according to the present invention.
Figure 2:
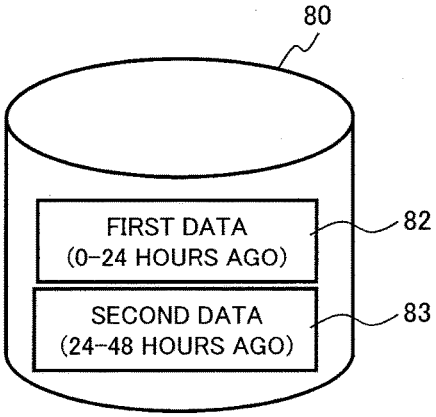
FIG. 2 is an explanatory view of a storage section 80 of an adaptor 8 for data retention.

An embodiment of the present invention will be described referring to the drawings. The elements designated with the same reference numerals represent the same or similar parts.

First Embodiment

FIG. 1 shows an overall structure of a first embodiment of an air conditioner diagnostic system according to the present invention.

Referring to FIG. 1 representing a multi-compartment type air conditioner for use in the building, reference numerals 1 and 2 denote an outdoor unit and an indoor unit, respectively. In this embodiment, two indoor units are employed. However, three or more indoor units may be employed. There may be the case that a plurality of outdoor units 1 are employed for connection to a large number of indoor units 2. In the case of use for small-scale store and household, the outdoor unit 1 may be provided corresponding to the indoor unit 2 one to one.

The indoor unit 2 is installed in the ceiling of the respective rooms in the building. A plurality of indoor units 2 may be installed in the single spacious room.

The outdoor unit 1 and the plurality of indoor units 2 are connected via a communication line 3. In this embodiment, the communication line 3 is further connected to a controller 9 for controlling a lighting system 5. A plurality of lighting systems 5 are connected to the controller 9 via a communication line 6 for lighting system. The communication line 3 dedicated to the air conditioner is used herein. However, there may be the case of employing an open network communication system adapted to the general building management system.

Referring to an example shown in FIG. 1, an adaptor (communication converter, LAN adaptor) 8 for communication is disposed on the middle part of the communication line 3 so as to allow communication with other equipment and a remotely located maintenance server system 7. In the example shown in FIG. 1, the adaptor 8 is connected to an arbitrary point on the communication line 3, through which a monitor device 4 disposed in a building manager office is connected. The monitor device 4 may be configured to be communicated with the maintenance server system 7 disposed in the remote location via Internet. The monitor device 4 may be directly connected to the communication line 3 without employing the adaptor 8.

The adaptor 8 includes a storage section 80 configured to retain operation data of the air conditioner. The data retention performed by the storage section 80 will be described. The data retained in the storage section 80 contain, for example, first data 82 from 0 to 24 hours before, and second data 83 from 24 to 48 hours before.

The second data 83 are periodically transmitted to the mobile communication terminal such as a multifunction mobile phone (smartphone) 10 and a tablet PC 11 so that capacity of the storage section 80 is minimized. This applies to the data retained in the storage section in each of the indoor units 2.

The storage section 80 of the adaptor 8 available for the air conditioner in entirety allows minimal use of data storage section for the respective indoor units 2 and the outdoor unit 1 of the air conditioner. This may realize the highly efficient system configured to retain the latest data corresponding to 48 hours in the indoor units 2 and the outdoor unit 1, and to send the operation data on the previous day to the adaptor 8 via the communication line 3 with small data size resulting from the off hours of the air conditioner, for example, at midnight.

The operation data of the outdoor unit 1 and the indoor units 2 are transmitted to the monitor device 4 via the communication line 3 so that the operation state of the air conditioner is monitored by the monitor device 4. The monitor device 4 may be configured to control the multi-compartment type air conditioner constituted by the outdoor unit 1 and the indoor units 2.

Figure 4:
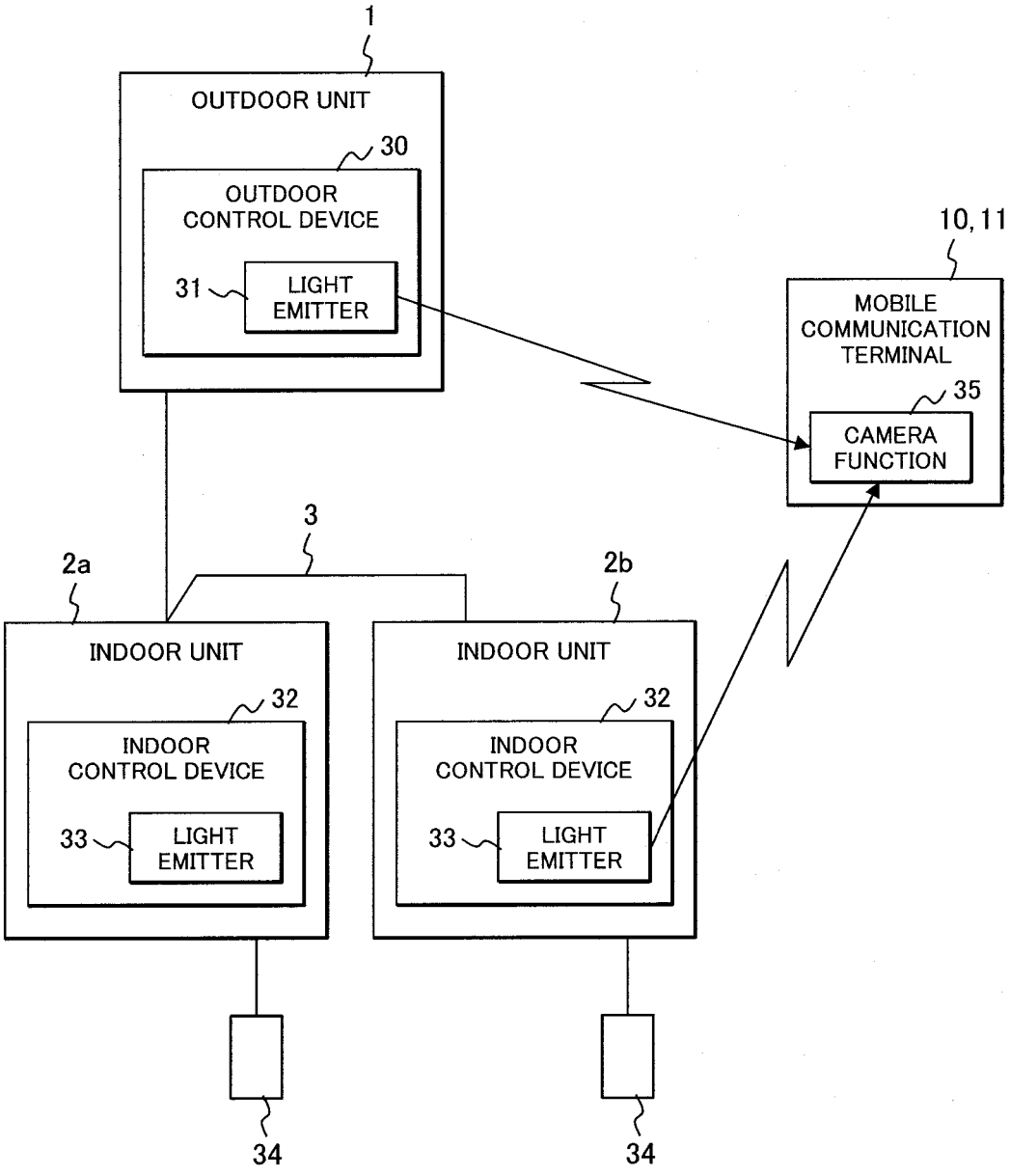
FIG. 4 is a block diagram for explaining another example of the communication unit as shown in FIG. 3.

Each of the indoor units 2 is provided with a remote control (controller) (see an element designated with the reference numeral 34 shown in FIG. 4) allowed to control the indoor unit 2.

In each room where the indoor unit 2 is installed, the lighting system 5 is provided, which is connected to the monitor device 4 via the communication line 6 for lighting system and the communication line 3. Accordingly, the monitor device 4 is allowed to monitor each ON/OFF state of the respective lighting systems 5 in the rooms, and to turn ON/OFF the respective lighting systems 5.

The monitor device 4 maybe connected to a remote monitor device (not shown), for example, a monitor center in a remote location via Internet as needed. By connecting the monitor devices remote from each other for ensuring data transmission and reception, the system allows the remote monitor device 7 to monitor the air conditioner, remotely control the air conditioner, and turn ON/OFF the lighting system.

Referring to the example shown in FIG. 1, the system is configured that the adaptor 8 disposed on the communication line 3 may be communicated with the mobile communication terminal such as the multifunction mobile phone 10 and the tablet PC 11 by wireless communication means, for example, infrared communication, Bluetooth®, WiFi (wireless LAN), or by wire. That is, the system is configured to allow transmission of the operation data and the model data of the air conditioner to the mobile communication terminal 10 or 11 only in response to the reception request sent therefrom.

Generally, as the components of the multifunction mobile phone 10 and the tablet PC for the communication mode, for example, Bluetooth are expensive, use of the aforementioned adaptor 8 may reduce the overall cost. The adaptor 8 has a built-in clock function 81 for transmitting clock data to the indoor unit 2 and the outdoor unit 1 at every constant time, which makes it possible to acquire timestamp of the data retained in the indoor unit 2 and the outdoor unit 1. The time of the clock function 81 may be corrected by means of a radio clock by standard wave, and in communication with the maintenance server 7, and the mobile communication terminal 10 or 11.

It is preferable to provide a maintenance notice unit for temporarily stopping operation of the air conditioner in the case where the air conditioner operation data cannot be read by the mobile communication terminal 10 or 11 within the predetermined time period. This makes it possible to offer the service for periodically checking the air conditioner operation state for the small-scale store without the full maintenance contract. This is effected by taking the air conditioner operation data periodically, and sending those data to the maintenance server 7, which are performed by the salesclerk of the store as the routine work.

The mobile communication terminal 10 or 11 is allowed to download the operation data indicating the air conditioner operation state, or the model data indicating model of the air conditioner, which are stored in the storage device (storage means) of the outdoor unit 1 and the indoor unit 2 via the communication line 3 of the air conditioner.

The operation data may be the rotation speed, discharge pressure, discharge temperature of the compressor provided for the outdoor unit, outdoor temperature, air intake temperature of the indoor unit, rotation speed and wind direction of a blower of the indoor unit, and human body detection information from a human body detection sensor.

The mobile communication terminal 10 or 11 may be communicated with the maintenance server system 7 installed in the remote location via the available communication line and communication network. The maintenance server system 7 which stores the diagnostic program corresponding to the respective models of the air conditioners is configured to diagnose the subject air conditioner using the diagnostic program corresponding to the model data through transmission of the model data and the operation data received by the mobile communication terminal 10 or 11 to the maintenance server system 7. The diagnostic program corresponding to each model is configured to diagnose whether the detection values of the air conditioner such as the discharge temperature, discharge pressure and current value are in a predetermined appropriate range for the respective models, and whether abnormality or abnormality sign exists so as to locate the abnormal point, by which the repair information with respect to the diagnosed abnormality is identified and provided.

The air conditioner of the embodiment is the one for business use, which is constituted by a plurality of indoor units 2 disposed in the building, and at least one outdoor unit 2 connected to those indoor units. The air conditioner for business use has highly diversified refrigerating capacity. It is therefore difficult in terms of capacity for the mobile communication terminals 10, 11 to store all the diagnostic programs corresponding to all the models of the air conditioners for business use. The system according to this embodiment is configured to transmit the received model data and the operation data to the maintenance server system 7 which ensures to diagnose the subject air conditioner using the diagnostic program corresponding to the model data. It is also configured to transmit the diagnostic result to the mobile communication terminals 10, 11 so as to be displayed on display units 10*a*, 11*a* of the mobile communication terminals 10, 11, respectively.

The system may be configured to allow the mobile communication terminals 10, 11 to diagnose the subject air conditioner using the diagnostic program corresponding to the model data in place of the maintenance server system 7. Specifically, in accordance with the model data of the air conditioner, which have been received by the mobile communication terminals 10, 11, the diagnostic program corresponding to the model data stored in the maintenance server system 7 is downloaded into the mobile communication terminals.

The mobile communication terminals 10, 11 may be configured to diagnose the subject air conditioner based on the operation data received therefrom using the downloaded diagnostic program, and to display the diagnostic result on the display units 10*a* and 11*a* of those mobile communication terminals.

The system allowed to diagnose the air conditioner using the diagnostic program corresponding to the model data ensures the mobile communication terminals 10, 11 to diagnose the air conditioner even in the location, for example, indoor environment where the mobile communication terminal cannot be connected to the communication line. For example, the adaptor 8 is connected to the mobile communication terminals 10, 11 through infrared communication so that the operation data and the model data of the air conditioner are downloaded into the mobile communication terminals. Then in the environment which allows connection of the mobile communication terminal to the communication line, the diagnostic program corresponding to the model data is downloaded into the mobile communication terminal through communication with the maintenance server system 7. Thereafter, the diagnosis is made by the mobile communication terminal near the air conditioner for repair while displaying the diagnostic result on the display unit of the mobile communication terminal.

As described above, based on the model data and the operation data received by the mobile communication terminals 10, 11, the system according to the embodiment is configured to allow the maintenance server system 7 or the mobile communication terminals 10, 11 to diagnose the subject air conditioner using the diagnostic program corresponding to the model data so that the diagnostic result is displayed on the display unit of the mobile communication terminal. This makes it possible to derive the correct failure cause and suitable repair information for the air conditioner from the operation data obtained from the air conditioner. Therefore, it is possible to perform correct diagnosis, maintenance and repair of the air conditioner in the location where the air conditioner is installed.

Figure 3:
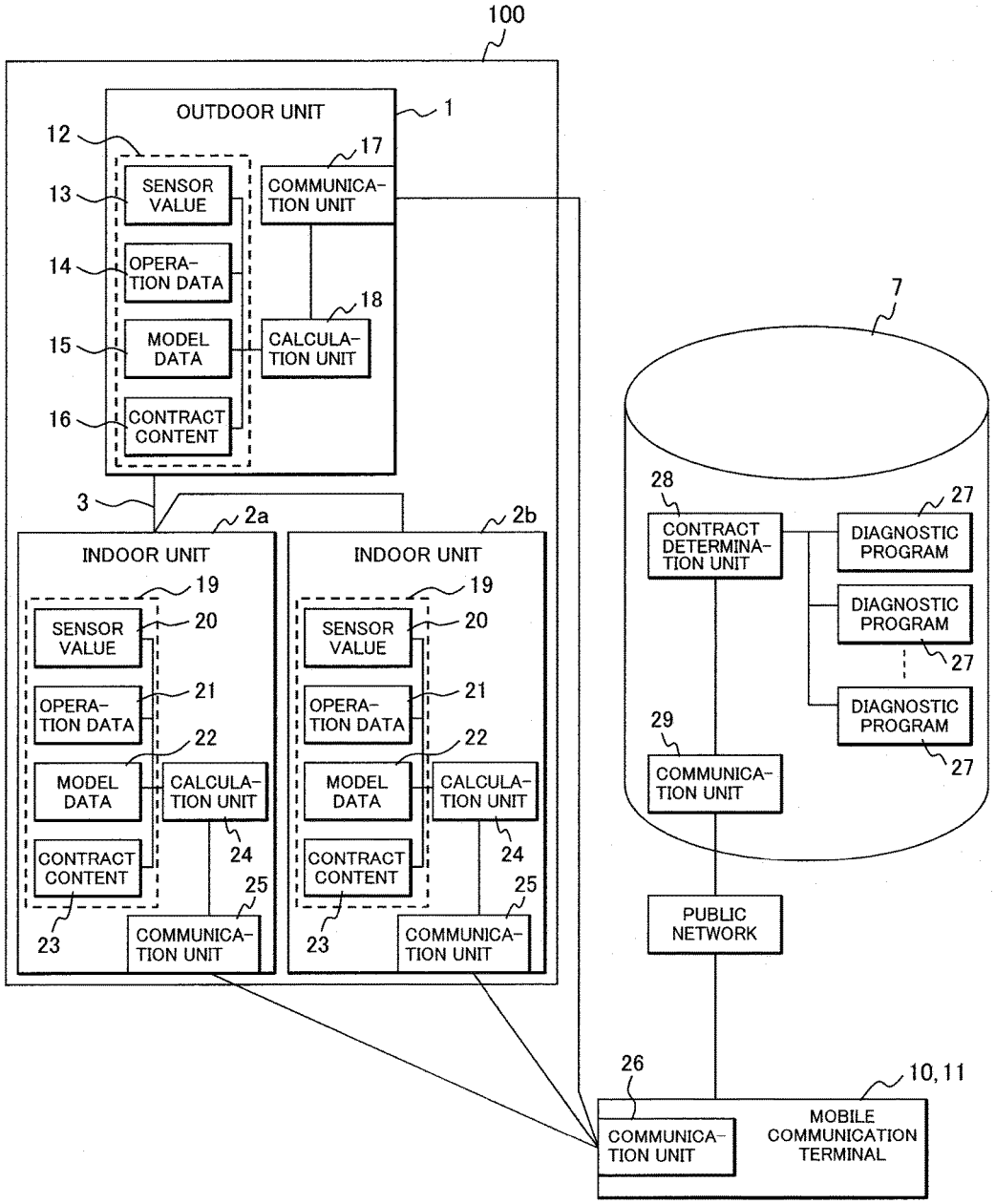
FIG. 3 is a block diagram for explaining the air conditioner diagnostic system shown in FIG. 1 in detail.

FIG. 3 is a block diagram for explaining the air conditioner diagnostic system shown in FIG. 1 in detail. FIG. 3 omits the monitor device 4 and the adaptor 8 for communication as shown in FIG. 1.

Referring to FIG. 3, a reference numeral 100 denotes an air conditioner constituted by the outdoor unit 1 and the plurality of indoor units 2 (2*a*, 2*b*), 7 denotes the maintenance server system disposed in the remote location, and 10, 11 denote the mobile communication terminals.

A control board of the outdoor unit 1 for the air conditioner 100 includes an information storage unit 12 for storing sensor values 13 detected by various sensors of the outdoor unit 1, operation data 14, model data 15, and a contract content 16, and a communication unit 17 for transmitting the information stored in the information storage unit 12 to the outside of the air conditioner. The information storage unit 12 further includes a calculation unit 18 which selects the information stored in the information storage unit 12 so as to be converted into data for transmission to the outside of the outdoor unit 1.

The sensor value 13 may be such detection value as the discharge pressure and discharge temperature of the compressor as well as the outside temperature. The operation data 14 may be the operation information such as the rotation speed of the compressor provided for the outdoor unit, opening degree of an expansion valve, and operation information of a switching valve. The model data 15 may be a model code of the outdoor unit 1. The contract content 16 may be the content of the maintenance service agreed with customers in advance, for example, the contract which covers diagnosis only of the abnormal point in the case of interruption due to failure, and the contract which broadly covers analysis on the operation information, and diagnosis of the abnormality sign so as to execute maintenance for the purpose of preventing the interruption due to failure. The aforementioned information is stored in the information storage unit 12 as the contract content 16.

The communication unit 17 is configured to allow the mobile communication terminal such as the multifunction mobile phone 10 and the tablet PC 11 to be communicated by wireless communication means such as infrared communication, Bluetooth, and WiFi or by wire, and to allow transmission of the operation data of the subject air conditioner (data required for diagnosis in accordance with the contract content), and the model data to the mobile communication terminals 10, 11 only in response to the reception request therefrom. Accordingly, the mobile communication terminals 10, 11 are configured to receive the operation data stored in the information storage unit 12 of the outdoor unit 1, and the model data of the outdoor unit 1 for downloading.

Likewise the outdoor unit 1 as described above, each control board of the indoor units 2*a*, 2*b* for the air conditioner 100 includes an information storage unit 19 for storing a sensor value 20 detected by various sensors of the indoor units 2*a*, 2*b*, operation data 21, model data 22, and a contract content 23, and a communication unit 25 for transmitting the information stored in the information storage unit 19 to the outside of the air conditioner. It is also provided with a calculation unit 24 which selects the information stored in the information storage unit 19 so as to be converted into data for transmission to the outside of the outdoor units 2*a*, 2*b*.

The sensor value 20 may be such detection values as the intake air temperature and the blow air temperature in the indoor units 2*a*, 2*b*, and the operation data 21 may be the data of the rotation speed of the blower, and the wind direction of a louver provided for the indoor unit. The model data 22 may be model codes of the subject indoor units 2*a* and 2*b*. The contract content 23 is analogous to the contract content 16 of the outdoor unit 1.

The calculation unit 24 and the communication unit 25 are analogous to the calculation unit 18 and the communication unit 17 of the outdoor unit 1. This ensures the mobile communication terminals 10, 11 to receive the operation data stored in the information storage units 19 of the indoor units 2*a*, 2*b*, and the model data of the indoor units 2*a*, 2*b* for downloading.

Each of the mobile communication terminals 10, 11 is provided with a communication unit 26 for communication with the communication units 17, 25 of the outdoor unit 1 and the respective indoor units 2*a*, 2*b* for the air conditioner 100. The communication unit 26 is configured similarly to the communication unit 17 of the outdoor unit 1.

Meanwhile, the mobile communication terminals 10, 11 may be communicated with the remotely located maintenance server system 7 via public network as the available communication line and the communication network. The maintenance server system 7 stores a plurality of diagnostic programs 27 corresponding to each model of the air conditioners as described above so that the maintenance server system 7 diagnoses a subject air conditioner using the diagnostic program 27 corresponding to the model data based on the model data and the operation data received by the mobile communication terminals 10, 11.

The maintenance server system 7 includes a communication unit 29 for communication with the mobile communication terminals 10, 11 via the public network, and a contract determination unit 28. Based on the contract content and the model data contained in the data received from the mobile communication terminals 10, 11, the contract determination unit 28 selects the diagnostic program corresponding to the contract content and the model data among those diagnostic programs stored in the server.

The maintenance server system 7 is allowed to diagnose the subject air conditioner using the selected diagnostic program and the received operation data, and to transmit the diagnostic result to the mobile communication terminals 10, 11 for display on the display units 10*a*, 11*a* thereof. The mobile communication terminals 10, 11 are configured to download the diagnostic programs selected corresponding to the model data and the contract content stored in the maintenance server system 7 in accordance with the model data of the air conditioner, which have been received by the mobile communication terminals. Using the downloaded diagnostic program, the mobile communication terminals 10, 11 diagnose the air conditioner based on the operation data received from the air conditioner, and displays the diagnostic result on the display units 10*a*, 11*a* (see FIG. 1).

The maintenance server system 7 also stores communication software for the mobile communication terminals 10, 11 so as to communicate with the communication units 17, 25 respectively disposed in the outdoor unit 1 and the indoor units 2 for the air conditioner 100, or the adaptor 8 (see FIG. 1) provided on the communication line 3. The mobile communication terminals 10, 11 each having the communication software downloaded are allowed to communicate with the communication units 17, 25, or 8 provided for the air conditioner 100. That is, any one of the outdoor units 1 for the air conditioner, which includes the communication units 17, 25, or the adaptor 8 (as one of the communication units) allows communication with the subject air conditioner.

In the case where the communication unit 17, 25 or the adaptor 8 for the air conditioner 100 is in the form of wireless communication means, other air conditioner adjacent to such communication means may cause communication of the mobile communication terminals 10, 11 with the plurality of air conditioners. The communication software downloaded into the mobile communication terminals 10, 11 is programmed to select any one of the plurality of air conditioners available for communication.

In other words, each of the mobile communication terminals 10, 11 includes a first communication unit (infrared communication, Bluetooth) available for communication with the communication units 17, 25, and the adaptor 8 provided for the air conditioner 100, and the first software (the communication software) with the program for downloading the model data and the operation data of the air conditioner via the first communication unit.

Each of the mobile communication terminals 10, 11 includes a second communication unit for communication with the remotely located maintenance server system 7 provided with the server which stores a plurality of diagnostic programs corresponding to the respective models of the air conditioner via the communication line and the communication network.

Each of the mobile communication terminals 10, 11 includes a second software with the program which communicates with the maintenance server system 7 via the second communication unit, and makes failure diagnosis of the air conditioner based on the downloaded operation data thereof by the use of the diagnostic program corresponding to the downloaded model data and the contract content of the air conditioner for displaying the failure diagnostic results on the respective display units.

The advantageous effect obtained by using the aforementioned mobile communication terminals 10, 11 will be described.

There may be often the case that the mobile communication terminal available for short-range communication with the air conditioner cannot receive the operation data thereof because of unavailable communication software dedicated to communication with the air conditioner installed therein. In many cases, therefore, the diagnostic system according to the embodiment in communication with the air conditioner cannot be used.

On the contrary, the mobile communication terminal having the first and the second communication units, and the first software and the second software installed therein may be available for communication so long as the air conditioner is provided with the communication means that allows transmission of the operation data and the model data. The use of the thus structured mobile communication terminal allows expansion of the coverage of the air conditioner to be diagnosed.

FIG. 4 is a block diagram for representing another example of the communication units 17, 25 and 26 as shown in FIG. 3.

Referring to FIG. 4, a reference numeral 1 denotes the outdoor unit having its built-in outdoor control device 30 provided with a light emitter 31. A light emitter 33 is also provided for the indoor control devices 32 built in the indoor units 2*a*, 2*b*, respectively connected to the outdoor unit 1 via the communication line 3. A reference numeral 34 denotes a remote control provided for each of the respective indoor units 2*a*, 2*b* so as to be controlled.

Reference numerals 10, 11 denote the mobile communication terminals each having a camera function 35. The operation data, model data, and the contract content stored in the information storage units 12 and 19 for the air conditioner may be downloaded by the mobile communication terminals 10, 11 in the following manner. That is, light is emitted from the light emitter 31 or 33 of the outdoor unit 1 or the indoor units 2*a*, 2*b* by converting the aforementioned data into light flicker information, and the emitted light (flicker information) is taken by the camera function 35 of the mobile communication terminal 10 or 11 so that the mobile communication terminal 10 or 11 receives the information stored in the air conditioner such as the operation data and the model data.

The light emitter is provided for each of the remote controls 34 of the indoor units 2*a*, 2*b* for emitting light so as to allow the mobile communication terminals 10, 11 to receive such information as the operation data and the model data stored in the air conditioner.

The outdoor unit 1 is connected to the indoor units 2*a*, 2*b* via the communication line 3. Accordingly, the light emitter may be disposed only at the single point in any location of the outdoor unit 1, the indoor units 2*a*, 2*b*, and the remote controls 34 thereof so as to allow the mobile communication terminals 10, 11 to receive the operation data and the model data of the outdoor unit 1 and the indoor units 2*a*, 2*b*, respectively.

Likewise, the communication units 17, 25 shown in FIG. 3 may be disposed in at least any of such locations of the outdoor unit 1, the indoor units 2*a*, 2*b*, and the remote controls 34 for the indoor units. The control board of the outdoor unit 1 or the indoor units 2*a*, 2*b* may be configured to supply power to the communication units 17, 25.

The system may be configured to display QR code® to the remote control instead of use of the light emitters 31, 33 so as to be read by the camera function 35 of the mobile communication terminal 10 or 11 for reception of the model data and the operation data.

The present invention is not limited to the aforementioned embodiment, but includes various modifications.

For example, in the embodiment, the present invention is applied to the air conditioner constituted by the single outdoor unit 1 and two indoor units. It is also applicable to the arrangement constituted by a plurality of outdoor units, and three or more indoor units. It may be further applied to the arrangement having the outdoor unit 1 and the indoor unit 2 corresponding to each other one to one.

The embodiment has been described for better understanding of the invention, and is not necessarily restricted to the one provided with all the structures of the description. The structure of any one of the embodiments may be partially replaced with that of the other embodiment. Alternatively, it is possible to add the structure of any one of the embodiments to that of the other embodiment. It is also possible to have the part of the structure of the respective embodiments added to, removed from and replaced with the other structure.

Information of the program for realizing the respective functions, determination values, and the respective set times may be stored in the recording device such as memory, hard disk, SSD (Solid State Drive) or the recording medium such as IC card, SD card, and DVD.

LIST OF REFERENCE SIGNS

1: outdoor unit, 2(2*a*, 2*b*): indoor unit, 3: communication line, 4: monitor device, 5: lighting system, 6: communication line for lighting system, 7: maintenance server system, 8: adaptor, 9: controller, 10,11: mobile communication terminal (10: multifunction mobile phone, 11: tablet PC), 10*a*, 11*a*: display unit, 12,19: information storage unit, 13,20: sensor value, 14,21: operation data, 15,22: model data, 16,23: contract content, 17,25,26: communication unit, 18,24: calculation unit, 27: diagnostic program, 28: contract determination unit, 29: communication unit, 30: outdoor control device, 32: indoor control device, 31,33: light emitter, 34: remote control, 35: camera function, 80: storage section, 81: clock function, 82: first data, 83: second data, 100: air conditioner

The invention claimed is:

1. An air conditioner diagnostic system of an air conditioner having an outdoor unit and an indoor unit connected via a communication line, wherein:

the air conditioner includes a control board disposed in the outdoor unit or the indoor unit, the control board includes a communication unit configured to transmit operation data indicating an operation state of the air conditioner and model data to a remote control configured to control the air conditioner;

the communication unit is further configured to transmit the operation data and the model data of the air conditioner to the remote control only in response to a reception request from a mobile communication terminal, the remote control is configured to display the operation data and the model data as a QR code and the mobile communication terminal is configured to receive the operation data and the model data from the remote control via a camera function, the mobile communication terminal is configured to communicate the operation data and the model data with a maintenance server system, installed in a remote location, which stores a diagnostic program corresponding to each model of the air conditioner; and based on the model data and the operation data received by the mobile communication terminal, the maintenance server system or the mobile communication terminal is configured to diagnose the air conditioner using the diagnostic program corresponding to the model data and the mobile communication terminal is configured to display a diagnostic result of the diagnostic program.

2. The air conditioner diagnostic system according to claim 1, wherein the communication unit is further configured to wirelessly transmit the operation data and the model data to the remote control.

3. The air conditioner diagnostic system according to claim 1, wherein the communication unit is further configured to transmit the operation data and the model data via an adaptor disposed on the communication line.

4. The air conditioner diagnostic system according to claim 1, wherein the mobile communication terminal is configured to download the diagnostic program corresponding to the model data stored in the maintenance server system based on the model data received by the mobile communication terminal, to diagnose the air conditioner based on the operation data received from the air conditioner using the downloaded diagnostic program, and to display the diagnostic result on a display unit of the mobile communication terminal.

5. The air conditioner diagnostic system according to claim 2, wherein communication between the communication unit of the air conditioner and the mobile communication terminal is executed by any one of infrared communication, Bluetooth, and WiFi.

6. An air conditioner diagnostic system of an air conditioner having an outdoor unit and an indoor unit, wherein:

a mobile communication terminal is configured to communicate with a maintenance server system, installed in a remote location, which stores a diagnostic program corresponding to each model of the air conditioner and communication software for the mobile communication terminal to communicate with the air conditioner, wherein the mobile communication terminal is configured to download the communication software, the air conditioner includes a control board with a communication unit configured to transmit operation data indicating an operation state of the air conditioner and model data to the mobile communication terminal, the mobile communication terminal is configured to communicate with the air conditioner by executing the downloaded communication software, the communication unit is further configured to transmit the operation data and the model data of the air conditioner only in response to a reception request from the mobile communication terminal;

based on the model data and the operation data received by the mobile communication terminal, the maintenance server system or the mobile communication terminal diagnoses the air conditioner using the diagnostic program corresponding to the model data for displaying a diagnostic result on a display unit of the mobile communication terminal.

7. The air conditioner diagnostic system according to claim 6, wherein:

the communication unit is a wireless communication unit; and wherein the downloaded communication software configures the mobile communication terminal is to select the air conditioner for communication from among a plurality of air conditioners.

8. An air conditioner diagnostic system of an air conditioner having an outdoor unit and an indoor unit, wherein:

each of the outdoor unit and the indoor unit includes an information storage unit configured to store operation data, model data, and contract contents, and a communication unit configured to transmit the operation data indicating an operation state thereof, the contents data and the model data to a mobile communication terminal, the operation data, the contract contents and the model data of the air conditioner is transmitted to the mobile communication terminal only in response to a reception request from the mobile communication terminal, the mobile communication terminal is configured to communicate the operation data, the contract contents and the model data of the air conditioner with a maintenance server system, installed in a remote location, which stores a plurality of diagnostic programs for determining an operation state of the air conditioner and further includes a contract determination unit configured to select a diagnostic program from among the plurality of diagnostic programs based on the model data and the contract contents, and a communication unit configured to transmit the selected diagnostic program to the mobile communication terminal, based on the model data and the operation data received by the mobile communication terminal, the mobile communication terminal is configured to diagnose the air conditioner using the diagnostic program received from the maintenance server, and to display a diagnostic result on a display unit of the mobile communication terminal.

9. An air conditioner diagnostic system of an air conditioner having an outdoor unit and an indoor unit, wherein:

the air conditioner includes a control board disposed in the outdoor unit or the indoor unit, and the control board includes a wireless communication unit configured to wirelessly transmit operation data indicating an operation state of the air conditioner and model data by light emission to a mobile communication terminal, the wireless communication unit is further configured to wirelessly transmit the operation data and the model data of the air conditioner by light emission only in response to a reception request from the mobile communication terminal, the mobile communication terminal is configured to receive the light emission from the wireless communication unit via a camera function, the mobile communication terminal is further configured to communicate with a maintenance server system installed in a remote location, which stores a diagnostic program corresponding to each model of the air conditioner; and based on the model data and the operation data received by the mobile communication terminal, the maintenance server system or the mobile communication terminal is configured to diagnose the air conditioner using the diagnostic program corresponding to the model data, and the mobile communication terminal is configured to display a diagnostic result of the diagnostic program on a display unit of the mobile communication terminal.

* * * * *